US011209167B1

(12) United States Patent
Gutierrez

(10) Patent No.: US 11,209,167 B1
(45) Date of Patent: Dec. 28, 2021

(54) FIREPLACE COVER

(71) Applicant: Leunam Gutierrez, Gainesville, GA (US)

(72) Inventor: Leunam Gutierrez, Gainesville, GA (US)

( * ) Notice: Subject to any disclaimer, the term of this patent is extended or adjusted under 35 U.S.C. 154(b) by 42 days.

(21) Appl. No.: 16/401,210

(22) Filed: May 2, 2019

(51) Int. Cl.
*F24B 1/192* (2006.01)
*A47G 5/04* (2006.01)

(52) U.S. Cl.
CPC ..... *F24B 1/192* (2013.01); *A47G 5/04* (2013.01)

(58) Field of Classification Search
CPC ..... A47G 5/04; F24B 1/192
USPC ..... 126/544, 547
See application file for complete search history.

(56) References Cited

U.S. PATENT DOCUMENTS 2,491,707 A * 12/1949 Boyden ..... A47G 5/04 160/351
2,604,157 A * 7/1952 Gaetano ..... A47G 5/04 160/126
2,841,218 A * 7/1958 Goodman ..... F24B 1/192 160/118
3,797,172 A * 3/1974 Cannon ..... E06B 7/2314 49/463
4,160,442 A * 7/1979 Fox ..... F24B 1/192 126/547
6,298,844 B1 10/2001 Skinkiss
8,186,645 B2 * 5/2012 Shaw ..... E04G 17/14 249/219.1
8,261,736 B1 * 9/2012 Olivarri ..... F24B 1/192 126/547
9,371,999 B2 6/2016 Vulpitta et al.
2004/0031481 A1 * 2/2004 Carzoli ..... F24C 15/28 126/544

* cited by examiner

*Primary Examiner* — Alfred Basichas
(74) *Attorney, Agent, or Firm* — Sanchelima & Associates, P.A.; Christian Sanchelima; Jesus Sanchelima

(57) ABSTRACT

A fireplace cover for covering an opening of a fireplace is disclosed. The fireplace cover comprises a panel having a top end and a bottom end. The fireplace cover comprises a plurality of handles. Further, the fireplace cover comprises a plurality of support legs provided at a bottom end of the panel. One end of each of plurality of support legs is mounted to the panel and the other end is placed on a ground surface to support the panel. Each of the plurality of support legs is provided as a L-shaped bracket. Each of the plurality of support legs comprises a support rod. A user lifts the panel using the plurality of handles to cover an opening of the fireplace. The plurality of support legs helps in placing the panel in an upright position.

9 Claims, 4 Drawing Sheets

FIREPLACE COVER

BACKGROUND OF THE INVENTION

1. Field of the Invention

The present disclosure generally relates to a field of fireplaces. More specifically, the present disclosure relates to a fireplace cover used to cover a fireplace in a building.

2. Description of the Related Art

It is known that fireplaces have long been used as a source for heat and light in buildings such as houses. The firehouses may be used as a supplemental source of heat and, even more importantly, an intimate and decorative addition to the house. Generally, the fireplaces are used in winters, in which wood is burned to produce heat. Typically, the fireplaces require occupants or users to ensure that the fire is put out before stepping out of the house. Failure to put off the fire may result in untoward consequences.

In order to avoid untoward consequences, the users may have to wait until all ashes are extinguished to close vents. Further, the user has to ensure that smoke continues to flow upwards through an exhaust vent so that the smoke does not enter the house.

In order to overcome the above problems, several solutions have been proposed in the past. One such solution includes providing a cover for the fireplaces. An example of the cover for the fireplace is disclosed in a U.S. Pat. No. 9,371,999. In U.S. Pat. No. 9,371,999B2, it is disclosed that a fireplace draft blocker which is easily assembled and disassembled is provided with a seal around its periphery of faux fur, bristles, or soft fabric and is supported by crossed rods which hold the four corners of the fireplace draft blocker in position and away from the fireplace itself.

Another example is disclosed in a U.S. Pat. No. 8,261,736. In U.S. Pat. No. 8,261,736B1, it is disclosed that a fireplace cover comprising a generally flat and flexible panel; a first slot disposed in the panel along the first side edge, wherein the first slot is adapted for receiving a removable first magnetic bar; a second slot disposed in the panel along the second side edge, wherein the second slot is adapted for receiving a removable second magnetic bar; a third slot disposed in the panel along the top edge, wherein the third slot is adapted for receiving a third magnetic bar; and a fourth slot disposed in the panel along the bottom edge, wherein the fourth slot is adapted for receiving a fourth magnetic bar.

Yet another example is disclosed in a U.S. Pat. No. 6,298,844. In U.S. Pat. No. 6,298,844B1, it is disclosed that the herein taught invention generally relates to domestic fireplaces particularly of the wood burning type and a method of, and apparatus for sealing such fireplaces to prevent the loss of conditioned air (heated and/or cooled) from the living quarters through such fireplaces.

Although the above disclosures are helpful in covering an opening of the fireplace, they have few problems. For instance, the above disclosures are helpful to close or seal the fireplace to reduce drafts of cold air from entering a house through the fireplace when it is not in use. Further, they are used to prevent the flow of air into the fireplace. As such, they cannot be used when the fireplace is being used for producing heat or remains of the ashes are still lit or on fire.

Other documents describing the closest subject matter provide for a number of more or less complicated features that fail to solve the problem in an efficient and economical way. None of these patents suggest the novel features of the present invention. Specifically, none of the disclosures in the art disclose a fireplace cover for covering a fireplace while the fireplace in use. Therefore, there is a need to provide a fireplace cover for covering an opening of a fireplace.

SUMMARY OF THE INVENTION

It is one of the main objects of the present invention to provide a fireplace cover for covering an opening of a fireplace and that avoids the drawbacks of the prior art.

It is one object of the present invention to provide a fireplace cover for covering an opening of a fireplace or chimney. The fireplace cover comprises a panel, a plurality of handles provided at the panel, and a plurality of support legs provided at a bottom end of the panel. One end of each of plurality of support legs is mounted to the panel and other end is placed on a ground surface to support the panel. Each of the plurality of support legs is provided as a L-shaped bracket. Each of the plurality of support legs comprises a support rod. A user lifts the panel using the plurality of handles to cover an opening of the fireplace. The plurality of support legs helps in placing the panel in an upright position.

It is another object of the present invention to provide a fireplace cover for covering an opening of a fireplace or chimney. The fireplace cover comprises a panel having a top end and a bottom end. The fireplace cover comprises a plurality of handles provided in proximity to the top end. Further, the fireplace cover comprises a plurality of support legs provided at the bottom. Each of the plurality of support legs comprises a support bar. One end of each of plurality of support legs is mounted to the panel and other end is placed on a ground surface to support the panel. A user lifts the panel using the plurality of handles to cover the opening of the fireplace. The plurality of support legs and the support bar at respective support leg help in placing the panel in an upright position.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses a fireplace cover for covering an opening of a fireplace or chimney. The fireplace cover comprises a panel having a top end and a bottom end. The fireplace cover comprises a plurality of handles provided in proximity to the top end. Further, the fireplace cover comprises a plurality of support legs provided at the bottom end of the panel. One end of each of plurality of support legs is mounted to the panel and the other end is placed on a ground surface to support the panel. Each of the plurality of support legs is provided as a L-shaped bracket. Each of the plurality of support legs comprises a support rod. A user lifts the panel using the plurality of handles to cover the opening of the fireplace. The plurality of support legs helps in placing the panel in an upright position.

Various features and embodiments of a fireplace cover for covering an opening of a fireplace or chimney are explained in conjunction with the description of FIGS. 1-5.

Figure 1:
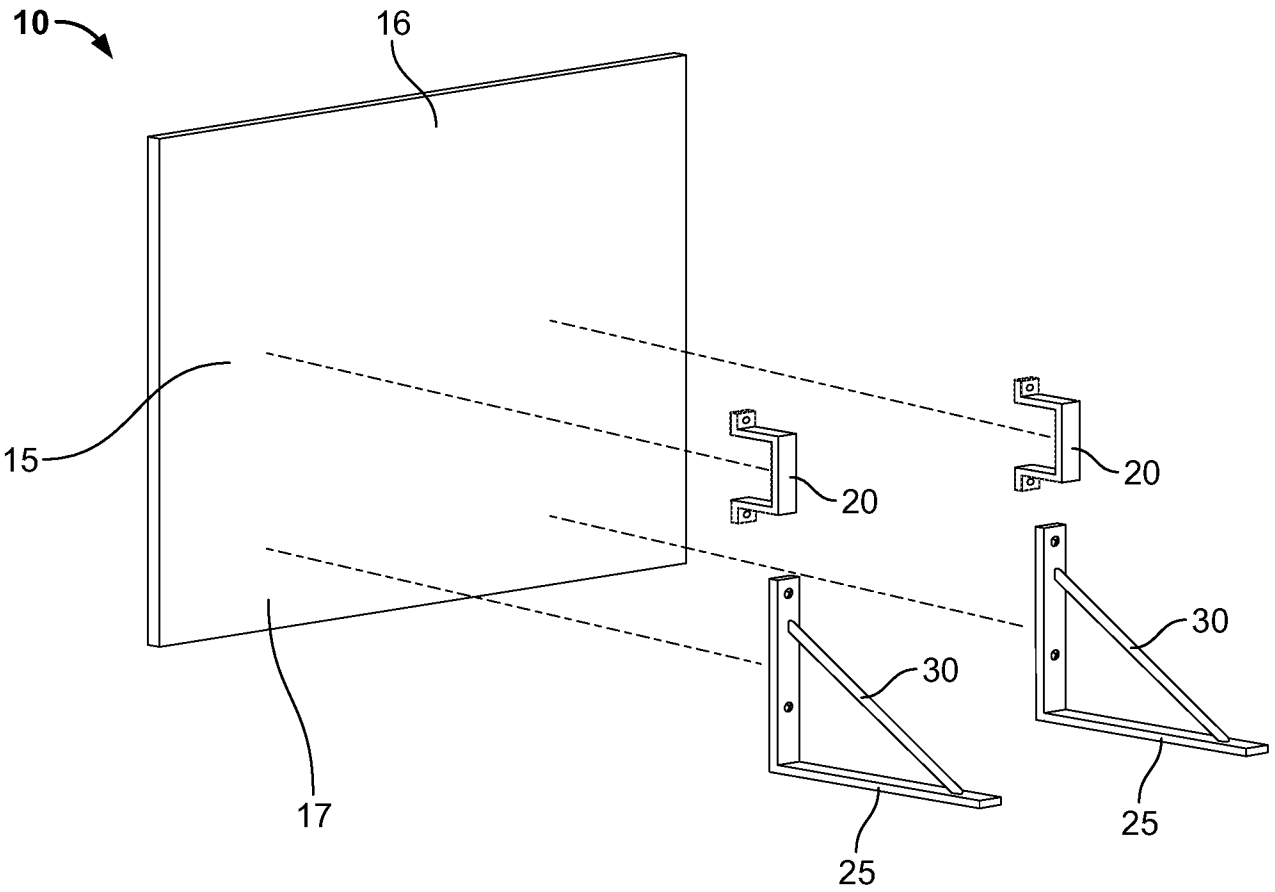
FIG. 1 illustrates an exploded view of a fireplace cover 10, in accordance with one embodiment of the present disclosure.
Figure 2:
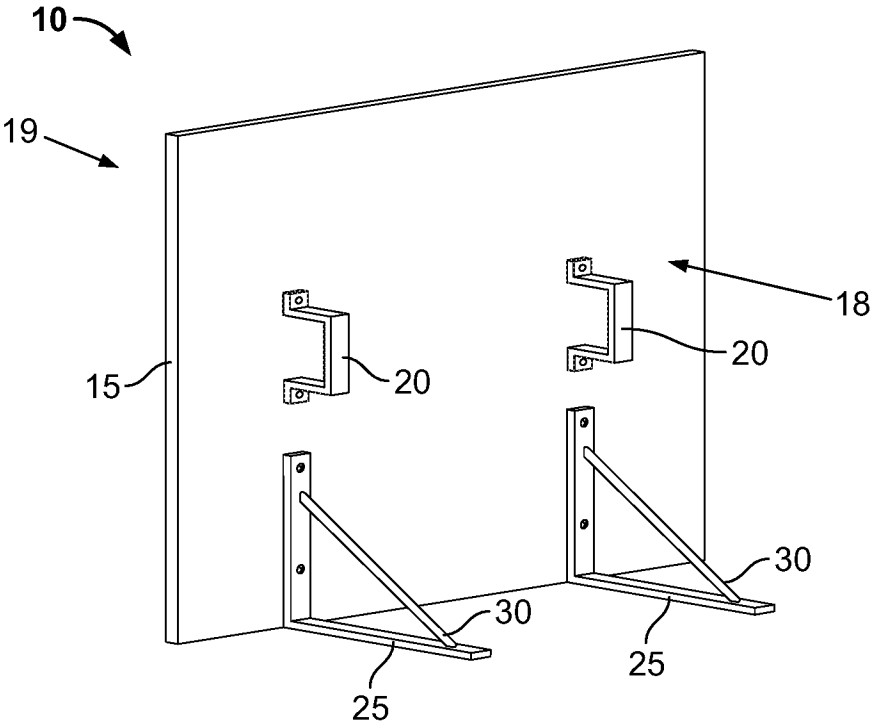
FIG. 2 illustrates a perspective view of a fireplace cover 10, in accordance with one embodiment of the present disclosure.

Referring to FIGS. 1 and 2, an exploded and a perspective view, respectively, of a fireplace cover 10 are shown, in accordance with one embodiment of the present disclosure. The fireplace cover 10 may include a panel 15. The panel 15 may be provided in a square, rectangular or any other shape. It should be understood that the panel 15 might be made up of metal or any other material capable of withstanding heat. Further, it should be understood that panel 15 might be provided as a flat and flexible panel. Alternatively, the panel 15 may also be provided in a curved, cone or a semicircular shape. The fireplace cover 10 may have a seal about the perimeter of the panel 15 in order to better secure the closing of the opening found on the fireplace C.

The panel 15 may comprise a top end 16 and a bottom end 17. Further, the panel 15 may comprise a front end 18 and a rear end 19. The front end 18 may indicate a front portion of the panel 15. The rear end 19 may indicate a rear portion of the panel 15.

As can be seen in FIG. 2, the panel 15 is provided with a plurality of handles 20 at the front end 18. It should be understood that the plurality of handles 20 might be provided in proximity to the top end 16 of the panel 15. However, it is obvious to provide the plurality of handles 20 at middle portion or at the bottom end 17 of the panel 15. It should be understood that each of the plurality of handles 20 is made up of metal or any other material capable of withstanding or resisting heat. The plurality of handles 20 may be welded to the panel 15 or may be mounted using fasteners.

In one example, each of the plurality of handles 20 might be provided with a protective cover (not shown) made up of heat resisting material which helps a user of the fireplace cover 10 to hold the plurality of handles 20 with his hands without additional mechanism such as protective hand gloves.

The panel 15 further comprises a plurality of support legs 25 provided at the front end 18 of the panel 15 in proximity to the bottom end 17 of the panel 15. As can be seen in FIG. 2, the plurality of support legs 25 is provided at the front end 18 of the panel 15.

Figure 3:
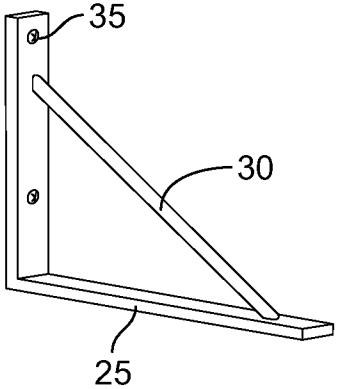
FIG. 3 illustrates a support leg 25 comprising a support bar 30, in accordance with one embodiment of the present disclosure.

Referring to FIG. 3, a perspective view of the support leg 25 is shown, in accordance with one embodiment of the present disclosure. It should be understood that the support leg 25 comprises a L-shaped bracket made up of metal or any other material capable of withstanding heat. The support leg 25 comprises a support bar 30, placed diagonally to support the support leg 25. It should be understood that one end of the support bar 30 is mounted to the panel 15 using connecting means 35 such as welding or fasteners or any other known mechanisms. Further, the other side of the support bar 30 is placed on a ground surface to hold the fireplace cover 10 in an upright position.

Figure 4:
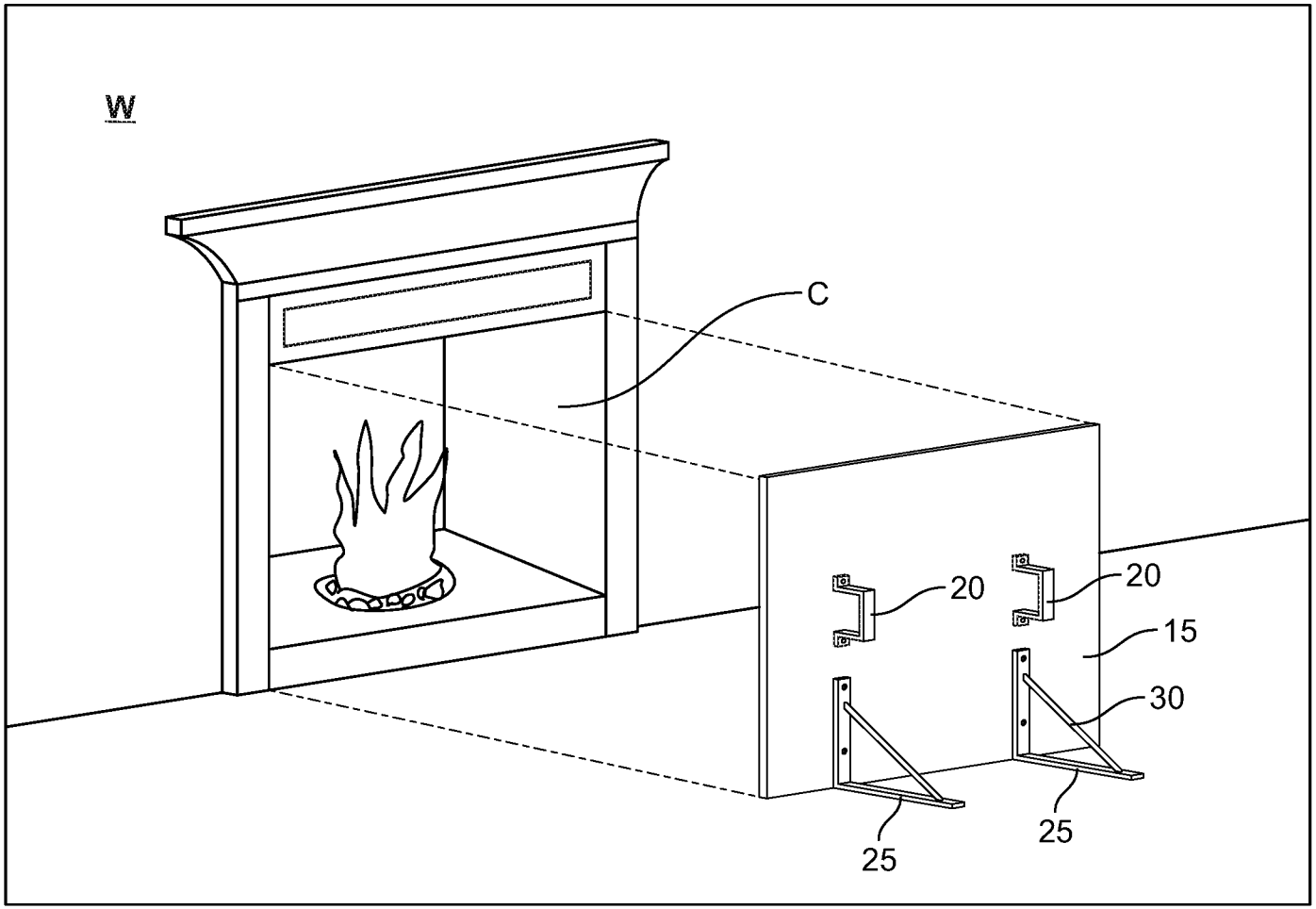
FIG. 4 illustrates the fireplace cover 10 aligned with a fireplace C, in accordance with another embodiment of the present disclosure.

Referring to FIG. 4, the fireplace cover 10 aligned with a fireplace C is shown, in accordance with one embodiment of the present disclosure. As known, the fireplace C is provided at a wall W. Typically, the fireplace C is provided at the bottom of the wall W.

Figure 5:
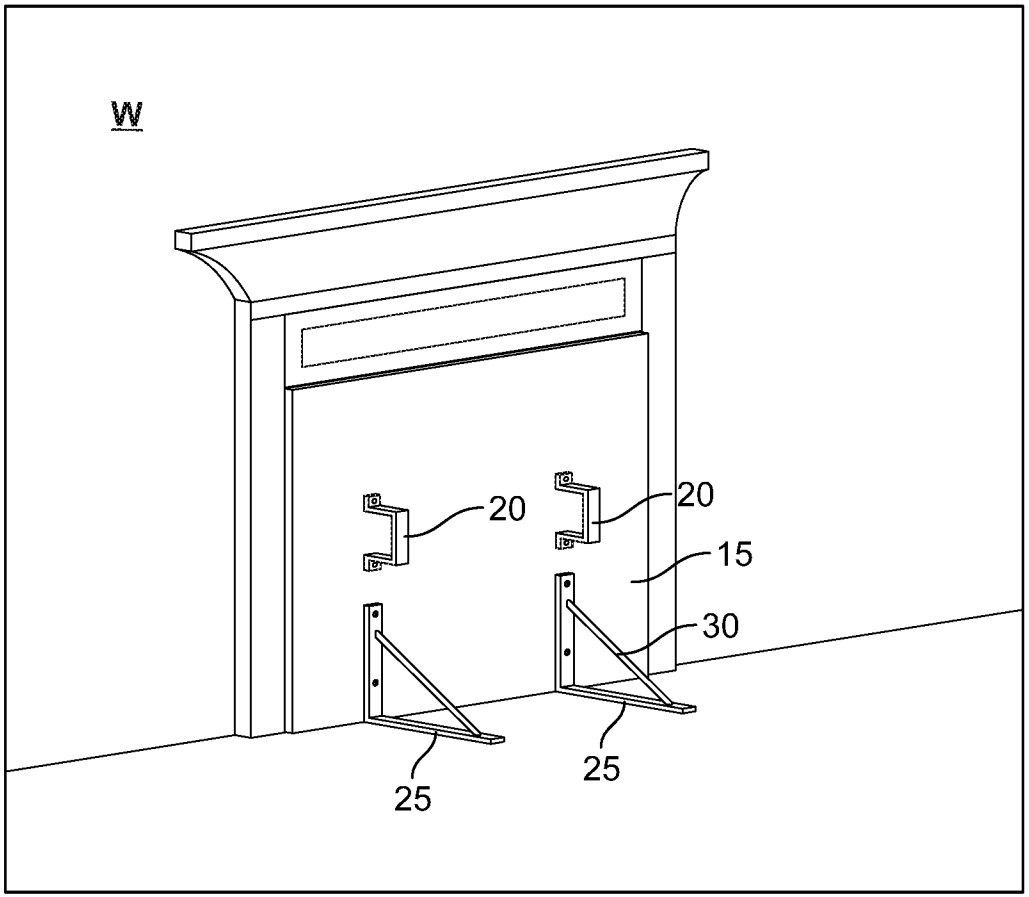
FIG. 5 illustrates the fireplace cover 10 used to cover an opening of the fireplace C, in accordance with one embodiment of the present disclosure.

Now referring to FIG. 5, the fireplace cover 10 positioned closed to the wall W to cover an opening of the fireplace C is shown, in accordance with one embodiment of the present disclosure. In other words, the fireplace cover 10 is placed against the opening of the fireplace C. The opening of the fireplace C may indicate an open area used to access interior of the fireplace C and place wood. Also, the opening is used to burn the wood and allow the heat to enter the house.

It should be understood that the user of the fireplace cover 10 might lift the fireplace cover 10 by holding the plurality of handles 20 and place against the opening of the fireplace C. When the fireplace cover 10 is placed against the opening of the fireplace C, the plurality of support legs 25 with the help of respective support bar 30 ensure that that fireplace cover 10 is positioned in an upright position.

Based on the above, the user may place the fireplace cover 10 against the opening of the fireplace C while the wood is being burned inside the fireplace C. Further, the user may place the fireplace cover 10 against the opening of the fireplace C before the ashes are extinguished. Alternatively, the user may place the fireplace cover 10 against the opening of the fireplace C to ensure that smoke is made to escape through an exhaust vent (not shown) provided at top of the house or chimney. Since, the panel 15 is made up the metal or any other material capable of withstanding heat, fireplace cover 10 i.e., the panel 15 can be placed or removed from the opening of the fireplace C when the fireplace C is in use or not being used. In order to place or remove the fireplace cover 10, the user may hold the fireplace cover 10 using the plurality of handles 20 with or without using the protective hand gloves.

Based on the above, it is evident that the fireplace cover 10 might be used to cover the opening of the fireplace C while the wood is being burned inside the fireplace C. Accordingly, the user may place the fireplace cover 10 and leave the house without having to worry about extinguishing ashes.

When placed against the opening of the fireplace C, the fireplace cover 10 ensures that the smoke continues to flow upwards through the exhaust vent. Further, the fireplace cover 10 blocks all cold air from flowing into the house.

Additionally, the user can place the fireplace cover 10 against the opening of the fireplace C to cover the opening, so that the user can step out of the house without having to wait until all ashes are extinguished.

Further, due to the construction of the fireplace cover 10 comprising the plurality of support legs 25 and support bar 30 coupled to the panel 15, the fireplace cover 10 is easy to deploy and remains sturdy when deployed.

Alternatively, the front end 18 of the panel 15 may be decorated with images or posters so as to provide aesthetic appeal to the fireplace cover 10 when used to cover the opening of the fireplace C.

In one alternate embodiment, magnetic members (not shown) may be provided at the rear end 19 of the panel 15 so as to securely mount the panel 15 to the wall W.

Although it is described that the fireplace cover 10 is used to cover the opening of the fireplace C, it is obvious to a person skilled in the art to use the fireplace cover 10 to cover the opening of a chimney provided inside or outside of a house.

It should be understood that the drawings are provided for illustrative purpose only and should not be construed in limited sense.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A fireplace cover for covering an opening of a fireplace, comprising:

a) a fireplace with an opening positioned within a wall;

b) panel having a flat rectangular shape with four perimeter sides corresponding with said opening of the fireplace, said panel having a top end, a bottom end, and lateral ends, wherein said panel further includes a front surface and a rear surface;

c) a first handle and a second handle mounted in proximity to the top end of the front surface of the panel, wherein each of the handles are parallel to each other, each of the handles consisting of two L-shaped members and a flat horizontal member which form a bracket, wherein said two L-shaped members are abuttingly mounted to the front surface and extends outwardly therefrom, each of the handles positioned as being parallel to the lateral ends of the panel;

d) a first support leg and a second support leg positioned entirely along the front surface of the panel, wherein each of the support legs are parallel to each other, wherein each of the support legs consist of an L-shaped bracket and a support bar, wherein the L-shaped bracket includes a vertical portion and a horizontal portion, the vertical portion and the horizontal portion being flattened rectangular members that are longitudinally aligned in a perpendicular relationship, wherein said vertical portion is abuttingly fastened to the front surface of the panel via fasteners, wherein said horizontal portion is flush with a ground surface and extends outwardly from the front surface of the panel, wherein the support bar is a cylindrical rod that includes support bar distal ends, the support bar distal ends being diagonally positioned from the vertical portion to the horizontal portion of the L-shaped bracket to form a triangular shape, the support bar distal ends being entirely between a distal vertical portion edge and a distal horizontal portion edge, the fasteners including two fasteners longitudinally disposed about the vertical portion located above and below one of the support bar distal ends;

e) a seal provided about the perimeter of the panel adapted to better close the fireplace opening, wherein said panel is adapted to be removably positioned on the opening of the fireplace to prevent cold air from entering a home.

2. The fireplace cover of claim 1, wherein the panel is made of heat resistant material.

3. The fireplace cover of claim 1, wherein the plurality of handles is made of heat resistant material.

4. The fireplace cover of claim 1, wherein the plurality of handles are welded to panel.

5. The fireplace cover of claim 1, wherein said panel is a flat flexible panel.

6. The fireplace cover of claim 1, wherein the plurality of handles are located directly above corresponding support legs.

7. A fireplace cover for covering an opening of a fireplace, consisting of:

a) a fireplace with an opening positioned within a wall;

b) panel having a flat rectangular shape with four perimeter sides corresponding with said opening of the fireplace, said panel having a top end, a bottom end, and lateral ends, wherein said panel further includes a front surface and a rear surface;

c) a first handle and a second handle mounted in proximity to the top end of the front surface of the panel, wherein each of the handles are parallel to each other, each of the handles consisting of two L-shaped members and a flat horizontal member which form a bracket, wherein said two L-shaped members are abuttingly mounted to the front surface and extends outwardly therefrom, each of the handles positioned as being parallel to the lateral ends of the panel;

d) a first support leg and a second support leg positioned entirely along the front surface of the panel, wherein each of the support legs are parallel to each other, wherein each of the support legs consist of an L-shaped bracket and a support bar, wherein the L-shaped bracket includes a vertical portion and a horizontal portion, the vertical portion and the horizontal portion being flattened rectangular members that are longitudinally aligned in a perpendicular relationship, wherein said vertical portion is abuttingly fastened to the front surface of the panel via fasteners, wherein said horizontal portion is flush with a ground surface and extends outwardly from the front surface of the panel, wherein the support bar is a cylindrical rod that includes support bar distal ends, the support bar distal ends being diagonally positioned from the vertical portion to the horizontal portion of the L-shaped bracket to form a triangular shape, the support bar distal ends being entirely between a distal vertical portion edge and a distal horizontal portion edge, the fasteners including two fasteners longitudinally disposed about the vertical portion located above and below one of the support bar distal ends;

e) a seal provided about the perimeter of the panel adapted to better close the fireplace opening, wherein said panel is adapted to be removably positioned on the opening of the fireplace to prevent cold air from entering a home.

8. The fireplace cover of claim 7 wherein said panel is a flexible panel.

9. The fireplace cover of claim 7 wherein said first handle and said second handle are made of a metal material.

* * * * *